United States Patent [19]

Rudszinat et al.

[11] Patent Number: 4,571,231

[45] Date of Patent: Feb. 18, 1986

[54] METHOD OF MAKING BLANKS FOR USE IN CIGARETTE PACKING MACHINES OR THE LIKE

[75] Inventors: Willy Rudszinat, Dassendorf; Karl-Heinz Pawelko, Marschacht, both of Fed. Rep. of Germany

[73] Assignee: Hauni-Werke Körber & Co. KG, Hamburg, Fed. Rep. of Germany

[21] Appl. No.: 424,480

[22] Filed: Sep. 27, 1982

[30] Foreign Application Priority Data

Jan. 8, 1982 [DE] Fed. Rep. of Germany ..... 3200335

[51] Int. Cl.[4] ..... B31B 1/00

[52] U.S. Cl. ..... 493/11; 83/917

[58] Field of Search ..... 83/210, 209, 917, 693; 493/11

[56] References Cited

U.S. PATENT DOCUMENTS

| | | | |
|---|---|---|---|
| 2,546,390 | 3/1951 | Danner | 83/158 |
| 4,056,024 | 11/1977 | Baert | 83/210 |
| 4,077,289 | 3/1978 | Rudszinar | 83/152 |

*Primary Examiner*—Leon Gilden

*Attorney, Agent, or Firm*—Peter K. Kontler

[57] ABSTRACT

An intermittently advanced web of wrapping material is subdivided into discrete blanks which are used in a cigarette packing machine for conversion into portions of soft packs by severing the web across its leader during each interval of dwell of the web so as to separate from the web a discrete blank, and by simultaneously removing one corner at the leading edge of the freshly formed blank. This obviates the need for the provision of triangular notches in the one and/or other marginal portion of the web. Successive blanks are transferred from the severing staton by suction arms for delivery into the range of the converting mechanism.

5 Claims, 7 Drawing Figures

METHOD OF MAKING BLANKS FOR USE IN CIGARETTE PACKING MACHINES OR THE LIKE

CROSS-REFERENCE TO RELATED CASE

Certain Figures of the drawing in the present application are identical with certain Figures of the drawing in the commonly owned copending patent application Ser. No. 315,434 filed Oct. 27, 1981 by Jürgen Steinhauer et al. for "Blank forming and manipulating apparatus for cigarette packing machines or the like".

BACKGROUND OF THE INVENTION

The present invention relates to a method of subdividing a web into discrete sections, particularly subdividing a web of paper, cardboard or other wrapping material into discrete blanks which can be converted into constituents of containers for arrays of cigarettes, cigars, cigarillos or analogous rod-shaped articles of the tobacco processing industry. Still more particularly, the invention relates to improvements in a method of making blanks which can be converted into constituents of so-called soft packs for arrays of cigarettes or analogous rod-shaped articles (hereinafter called cigarettes for short).

Soft packs which are produced in cigarette packing machines are normally assembled of several blanks, e.g., a blank consisting of metallic foil, at least one blank consisting of paper or cardboard, and a blank made of transparent or translucent material. Such blanks can be prefabricated and stored in a magazine which is installed in or adjacent to the packing machine, and the machine then further comprises a suitable mechanism which transfers blanks from the magazine to the location where the blanks are converted into inner envelopes, outer envelopes or other constituents of cigarette packs. Alternatively, the blanks are obtained by subdividing a web of wrapping material into sections by severing the web across its leader so that the yields a succession of discrete sections or blanks which are ready for conversion into constituents of packs. The web is drawn from a reel or another suitable source of supply and can be subdivided into a succession of blanks in a manner as disclosed in the aforementioned commonly owned copending application Ser. No. 315,434 of Steinhauer et al. The supply of web on the core of the reel is provided with printed matter and other informative or decorative material, and the severing action of the apparatus is such that each of the blanks contains the same information or decorative material. The present invention relates to a method and apparatus for obtaining blanks or like web sections by repeatedly severing a web directly in or adjacent to a packing machine for cigarettes or the like.

As disclosed in the aforementioned copending application Ser. No. 315,434, the web is preferably advanced in stepwise fashion and is severed during the intervals of dwell between successive stepwise movements in a predetermined direction. Successive sections or blanks are thereupon engaged by suitable blank transferring instrumentalities for introduction into the packing machine proper, e.g., to a station where the blanks are draped around hollow mandrels containing arrays of cigarettes in predetermined formations, normally arrays containing two outer layers of seven cigarettes each and a median layer containing six cigarettes which are staggered sideways with reference to the cigarettes of the outer layers.

If the seam where the marginal portions of a converted blank overlap each other is to be adjacent to an edge flanking a major side of the converted blank, both marginal portions of the blank are normally provided triangular cutouts or notches. It would suffice to provide such notches only in one marginal portion of the web which is being converted into discrete blanks, namely, one notch for each of the blanks, so that a blank which has been separated from the remainder of the blank is devoid of one corner. However, for convenience of manufacture, the web is normally formed with two rows of triangular notches, one row in each of the two marginal portions. The web is further provided (or can be provided) with a row of indicia which are monitored by a suitable scanner to ensure that the web is severed at predetermined intervals and in such a way that each cut is made between two transversely aligned triangular cutouts. This guarantees that each blank is devoid of two of its corners (due to the presence of transversely aligned triangular notches in the respective portions of the web). The cutting operation must be carried out with a high degree of precision, not only as regards the making of notches and the alignment of notches in one marginal portion with the notches in the other marginal portion of the web but also as concerns the position of the cutting plane with reference to the nearest notches. In the absence of adherence to such high degree of accuracy, the appearance of the blanks and of the envelopes which are obtained therefrom would be unsightly and therefore unacceptable to the manufacturer as well as to the purchaser of cigarette packs. Adherence to very high degrees of accuracy in connection with the application of indicia to the web, in connection with the making of notches in the marginal portions of the web, in connection with the scanning and advancing of the web, as well as in connection with cutting in a plane which is optimally positioned with reference to the neighboring notches, presents serious problems in many high-speed packing machines which turn out several hundreds of cigarette packs per minute.

OBJECTS AND SUMMARY OF THE INVENTION

An object of the invention is to provide a novel and improved method of converting a running web of wrapping material into discrete blanks for use in cigarette packing or analogous machines.

Another object of the invention is to provide a method which ensures that the blanks are acceptable, optically as well as in other respects, even if the web is not marked, advanced and severed with a maximum degree of accuracy.

A further object of the invention is to provide a method which ensures that the removal of one or more corners from the material of the web invariably takes place in such a way that the blanks of a long or a short series of successively produced blanks are of identical size and shape.

An additional object of the invention is to provide a method which can be practiced by resort to a relatively simple, compact and rugged apparatus.

The invention resides in the provision of a method of subdividing a web into discrete sections, particularly for subdividing a web of paper, cardboard or other suitable wrapping material into a succession of discrete blanks preparatory to conversion of such blanks into envelopes or analogous constituents of soft packs for arrays of cigarettes or other rod-shaped smokers' products. The method comprises the steps of moving the web lengthwise in a predetermined direction and along a predetermined path in stepwise fashion across a fixed cutting plane which is located in a predetermined portion of the path so that the foremost portion or leader of the web is located at one side and the remaining portion of the web is located at the other side of the cutting plane during each interval of dwell of the web between successive lengthwise movements, making cuts across the web in the cutting plane during the intervals of dwell of the web so that the foremost portion of the web is separated from the remaining portion and such portions of the web are provided with corners disposed at the respective sides of the cutting plane, and removing at least one corner of at least one such portion of the web during each interval of dwell.

The removing step can include severing a corner from the foremost portion of the web not later than upon at least partial separation of the foremost portion from the remaining portion of the web. It is presently preferred to select the severing step in such a way that it includes removing from the foremost portion of the web a corner which was formed thereon while the foremost portion was still an integral part of the remaining portion of the web, i.e., to remove a corner from that edge face of the preferably at least partially separated foremost portion which was formed during the preceding interval of dwell of the web.

The method preferably further comprises the steps of providing the web with a series of longitudinally spaced-apart indicia in the form of opaque marks, notches and/or a combination of different indicia, and utilizing successive indicia for selection of the length of stepwise movements of the web in the aforementioned direction. The utilizing step can comprise optically scanning the web for the presence of indicia at a predetermined location ahead of the cutting plane, as considered in the aforementioned direction (i.e., in a second portion of the path which is located ahead of the predetermined portion), generating electric or other signals on detection of successive indicia, and arresting the web in response to the generation of such signals, preferably with a predetermined delay. The arresting step can be carried out in several stages, i.e., the generation of a signal can entail a reduction of the speed of lengthwise movement of the web, and such reduction is thereupon followed by a reduction to zero speed, e.g., in response to renewed detection of the indicium which has caused the aforementioned reduction of the speed of the web.

The novel features which are considered as characteristic of the invention are set forth in particular in the appended claims. The apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
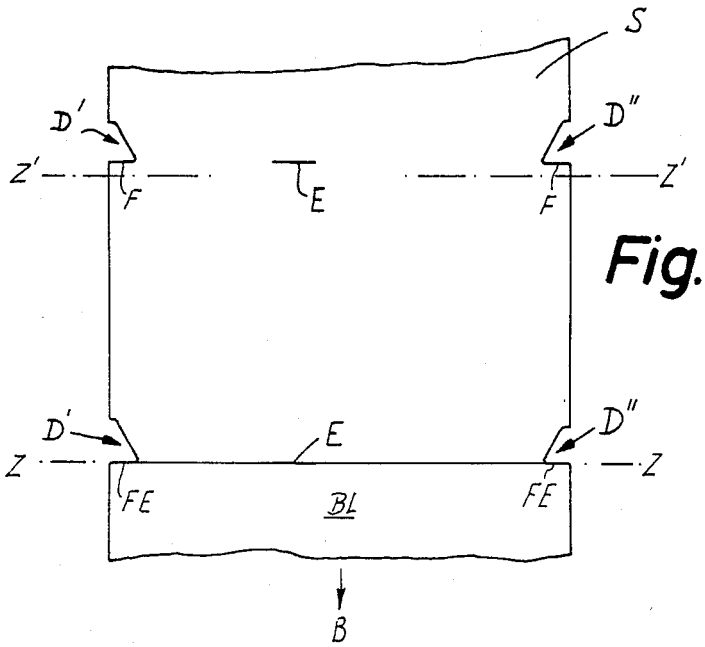
FIG. 1 is a fragmentary plan view of a web which is subdivided into discrete blanks in accordance with heretofore known methods.

Referring first to FIG. 1, there is shown a portion of a web S which is advanced stepwise in the direction of arrow B and is severed during the intervals of dwell of the web between successive stepwise advances in the direction of arrow B. One marginal portion of the web S is formed with a row of equidistant triangular notches D′, and the other marginal portion of the web S is formed with a row of equidistant triangular notches D″. Each notch D′ should be accurately aligned with a notch D″, as considered at right angles to the direction of intermittent movement of the web S. The web S is further provided with printed matter and/or coloring matter as well as with a series of equidistant indicia E (preferably in the form of optically detectable markers) which are scanned by a suitable optical monitoring system serving to regulate the operation of means for moving the web in stepwise fashion. Signals which are generated on detection of indicia E are utilized to arrest the web S in such positions that cuts are made transversely across the web in a plane Z-Z so that the leading edge of each freshly formed blank BL is devoid of corners due to severing in a plane which includes the front edge faces FE flanking the foremost portions of the respective notches D′ and D″.

However, if a cut is made slightly off the optimum cutting plane, e.g., in the plane Z′—Z′, the resulting blank is totally unacceptable because its leading edge is not devoid of corners, i.e., the two ends of the leading edge are provided with laterally extending narrow strips or flaps F which detract from the appearance of the blank and can interfere with its conversion into the envelope of a soft pack for arrays of cigarettes or the like.

Figure 7:
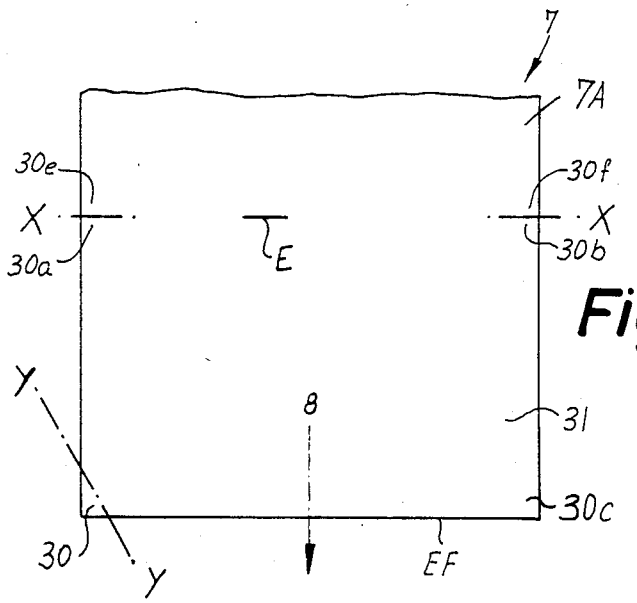
FIG. 7 is a fragmentary plan view of a portion of a web which is subdivided into discrete blanks in accordance with the method of the present invention and by resorting to the apparatus of FIGS. 2 to 6.

Referring now to FIG. 7, there is shown a web 7 which is moved stepwise in the direction of arrow 8 and is treated in accordance with the method of the present invention. This web is also provided with a series of indicia E (only one shown) which are scanned for the purpose of arresting the web at regular intervals. The cutting plane is shown at X—X. The foremost portion or leader 31 of the web 7 is located at one side of the cutting plane X—X (namely, below such plane, as viewed in FIG. 7) during each stoppage of the web 7, i.e., during each interval of dwell between successive stepwise advances of the web. In contrast to the web S of FIG. 1, which is provided with two rows of prefabricated notches D′ and D″ (such notches are machined into the respective marginal portions of the web S during making in a paper processing plant or the like), the web 7 of FIG. 7 need not be provided with any notches prior to introduction into the packing machine, i.e., the two marginal portions of the web 7 are intact during advancement of such marginal portions toward the cutting plane X—X. During each interval of dwell of the web 7, a novel material removing or separating device of the improved apparatus removes from the freshly obtained web portion or blank 31 a corner 30 by severing the blank 31 in the plane Y—Y. This ensures that the appearance of each freshly formed web section or blank 31 is identical with that of the preceding blanks because the dimensions of removed material patches (corners 30) are evidently identical if the web 7 is advanced by steps of at least approximately identical length and if the distance between the planes X—X and Y—Y at least approximates the desired or optimum length of a blank 31 (as considered in the direction of arrow 8).

It will be noted that the method of the present invention constitutes a radical departure from the previously known methods. Thus, the making of triangular notches in one or both marginal portions of the web can be dispensed with. The making of such notches in the web (normally subsequent to application to the web of printed matter, coloring material and/or others) presents many problems and contributes to the cost of cigarette packs. Moreover, adherence to a high degree of accuracy in the making of such notches also presents serious problems, the same as adherence to the required accuracy in connection with stepwise transport of the web so as to make sure that the cutting plane will not deviate from the cutting plane Z—Z of FIG. 1, i.e., that the web will be severed in the plane which includes two front edge faces FE whenever the web S dwells between two successive movements in the direction of arrow B shown in FIG. 1.

The mechanism which is used to separate or remove the corner 30 of each of a series of blanks 31, which are produced in accordance with the method and in the apparatus of the present invention, can be readily designed to remove both corners (30 and 30*c*) at the leading edge EF of the freshly formed blank 31. Furthermore, the position of the apparatus or mechanism which removes the corner 31 can be selected in such a way that the mechanism separates the corner 30*a* and/or 30*b* of each freshly formed blank 31, or that the mechanism removes the corner 30*e* and/or the corner 30*f* at the leading edge of the remaining portion 7A of the web 7 shown in FIG. 7. All that counts is to ensure that one or more corners are removed from the blank 31 and/or from the remaining portion 7A of the web 7 during each interval of dwell of the web, i.e., during each of those intervals when a fresh blank is being separated from the remaining portion of the web. Such mode of removing one or more corners from the web portion 31 and/or 7A invariably ensures that successive blanks are at least substantially identical and prevents the making of transverse cuts (plane X—X of FIG. 7) in a manner which would render the resulting blanks useless for conversion into envelopes of soft packs for arrays of cigarettes or analogous commodities.

Removal of corners 30 from the leading edges EF of successive blanks 31 (i.e., at a station which is remote from the cutting plane X—X and is disposed downstream of such cutting plane, as considered in the direction of arrow 8) is desirable and advantageous because it ensures that the severing tools are not crowded in one and the same area of a packing or a like machine. Moreover, it provides more freedom for selection of instrumentalities which are employed to remove a corner from the leading edge of each freshly formed blank.

In accordance with certain heretofore known proposals, the markers or indicia E shown in FIG. 1 are omitted and the one and/or the other row of triangular notches (D′ or D″) is used as a series of indicia which are scanned by an optical or other monitoring system in order to ensure accurate positioning of the web S with reference to the cutting plane Z—Z. This is not possible if the blanks 31 are made in accordance with the method which has been explained in connection with FIG. 7, i.e., when the marginal portions of the blank 7 are devoid of notches. However, the making of indicia E does not contribute to the cost of the blanks 31 since the web 7 is caused to pass through an imprinting mechanism anyway so that the application of indicia E which are shown in FIG. 7 does not require the provision of a separate imprinting, notching or other indicia-producing mechanism.

Figure 2:
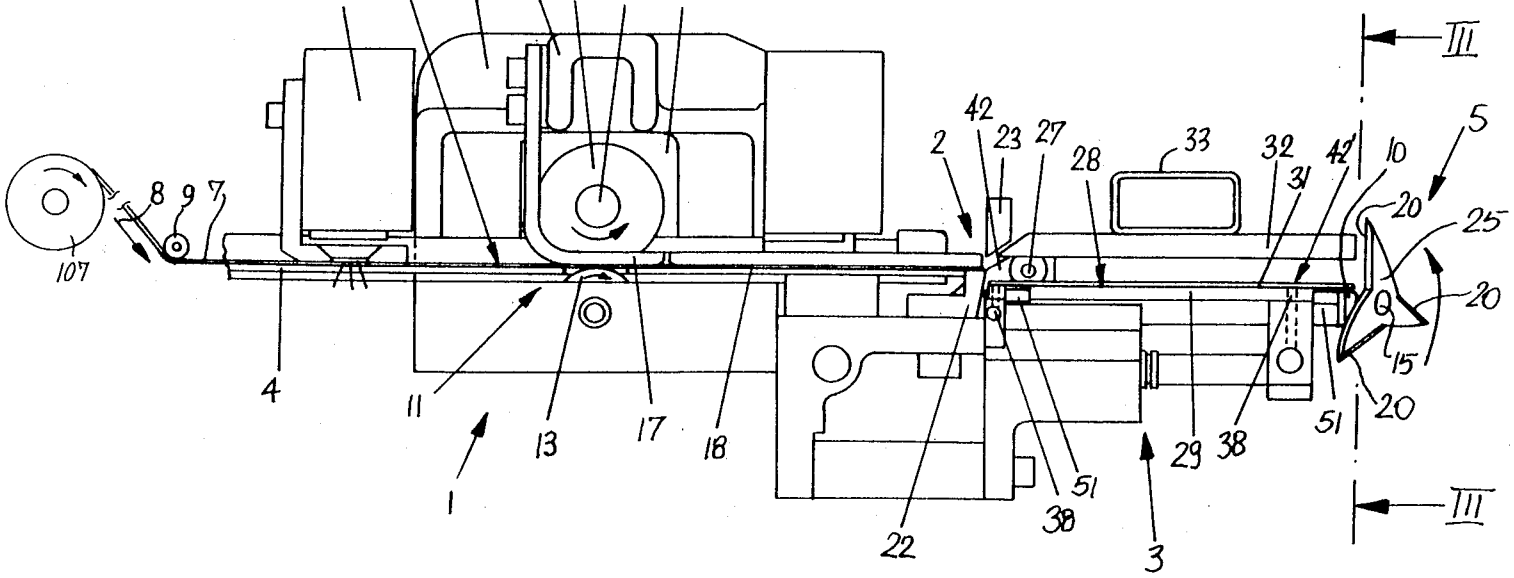
FIG. 2 is a schematic front elevational view of a blank forming and processing apparatus which embodies one form of the invention.
Figure 3:
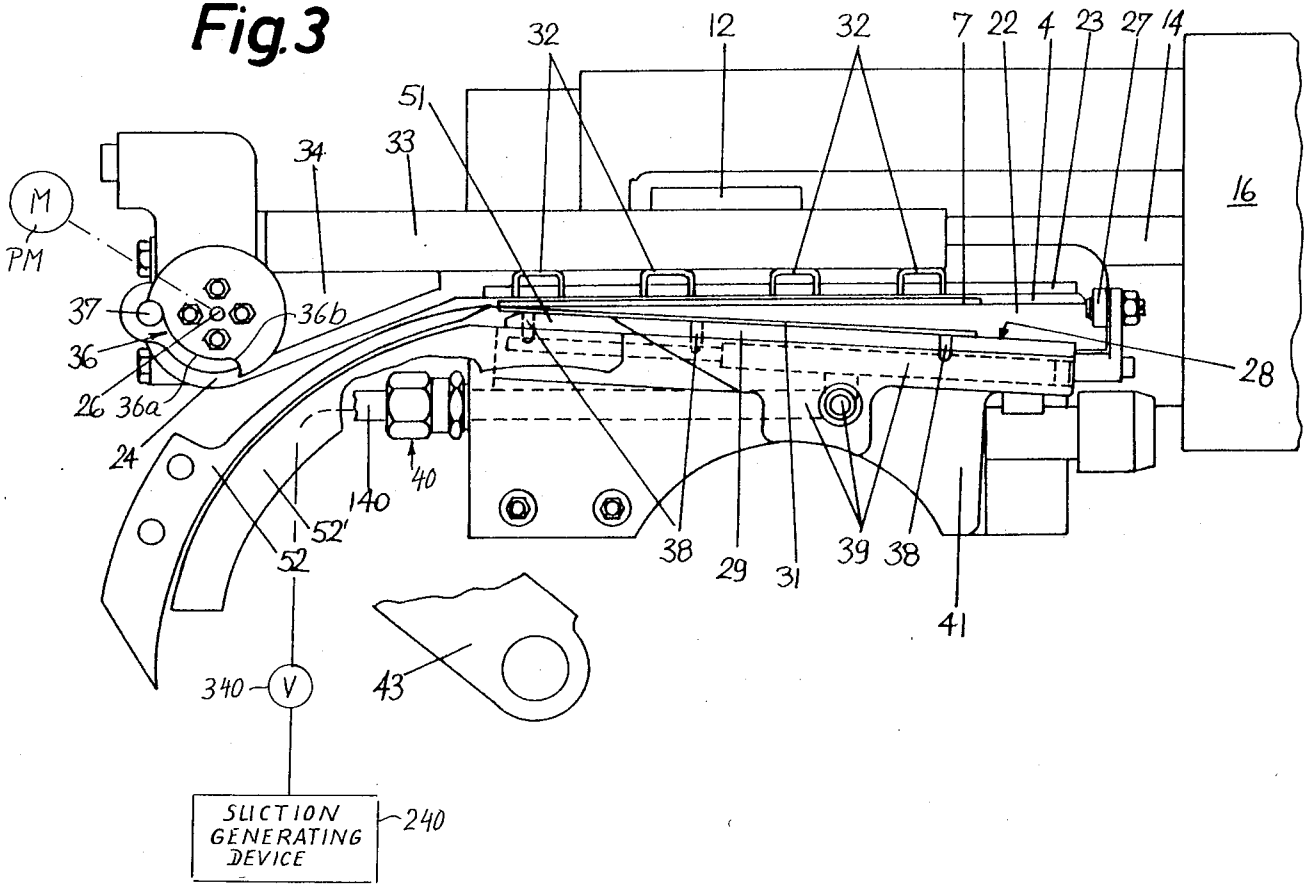
FIG. 3 is an end elevational view of the apparatus as seen in the direction of arrows from the line III—III of FIG. 2, with certain parts omitted.

FIGS. 2 and 3 show a portion of a packing machine of the type known as COMPAS (manufactured by the assignee of the present application), and more particularly a blank forming and manipulating apparatus which can be used in the packing machine to convert a continuous web or strip 7 of coherent blanks into a series of discrete blanks 31 which are thereupon delivered to the wrapping station of the packing machine for conversion into envelopes of successive soft packs. In the view of FIG. 3, the web 7 advances toward the observer of the drawing, i.e., at right angles to the plane of FIG. 3. FIG. 2 shows the apparatus in a side elevational view as seen from the left-hand side of FIG. 3.

As can be best seen in FIG. 2, the apparatus comprises a transporting or moving unit 1 which moves the web 7 lengthwise along a predetermined path, a cutting unit 2 which severs the leader of the web 7 at regular intervals to form a succession of discrete blanks or foremost web sections 31, and a blank transferring unit 3 which serves to transport the blanks 31 away from the severing station.

The moving unit 1 comprises a substantially horizontal plate-like support or platform 4 having an upper side or surface 6 which defines the aforementioned path for the web 7. The unit 1 moves the web 7 lengthwise in the direction which is indicated by the arrow 8. The web 7 is drawn off a source of supply here shown as a reel or bobbin 107 and is deflected by a guide roll 9 which is an idler roll installed upstream of the platform 4. Still further, the moving unit 1 comprises a web advancing assembly 11 having a driven upper rotary member or roller 12 and a lower rotary member or counterroller 13 which is located below the path for the web 7 opposite the roller 12 and urges the web against the periphery of the roller 12. The nip of the rollers 12, 13 is at least substantially coplanar with the upper side 6 of the platform 4. The means for driving the roller 12 comprises a variable-speed d-c motor 16 whose output shaft 14 is directly connected with and transmits torque to the roller 12. The web advancing assembly 11 is installed in the region of a hold-down device 17 and upstream of an elongated rail 18 serving to maintain the web 7 in contact with or close to the upper side 6 of the platform 4. The distance between the undersides of the hold-down device 17 and rail 18 on the one hand, and the upper side 6 on the other hand, is negligible, i.e., it is only slightly greater than the thickness of the web 7. The hold-down device 17 is a substantially L-shaped member whose upwardly extending leg is affixed to a bridge 19 which, in turn, is affixed to the frame 21 of the blank forming and manipulating apparatus. The frame 21 may form part, or may constitute a constituent, of the housing of the packing machine. The horizontal lower leg of the hold-down device 17 extends to both sides (i.e., upstream and downstream) of the nip of the rollers 12 and 13.

The moving unit 1 serves to advance the web 7 intermittently and through increments or distances of predetermined length, namely, through distances corresponding exactly to the length of a blank 31. The leader of the web 7 is thereby advanced into the severing station which extends to the right of the vertical cutting plane X—X (FIG. 7) defined by the coplanar edges of a pivotable upper knife 23 and a stationary lower knife or counterknife 22 of the cutting unit 2 (reference should be had to FIG. 2 of the drawing). The knives 22 and 23 resemble the blades of shears or tongs except that the pivot axis for the upper knife 23 does not or need not intersect the lower knife or counterknife 22. As can be seen in FIG. 3, the upper knife 23 is mounted on a knife holder 24 which is pivotable about the axis of a shaft 26 shown in the left-hand portion of FIG. 3 but omitted in FIG. 2 for the sake of clarity. The pivot axis which is defined by the shaft 26 is parallel to the path for the web 7, and the cutting edges of the knives 22 and 23 extend transversely of such path, i.e., at right angles to the plane of FIG. 2. The shaft 26 receives motion from the main prime mover PM of the packing machine and is driven through the medium of a suitable reversible drive which ensures that the upper knife 23 can turn back and forth in synchronism with the operation of the packing machine.

A roll 27, which is shown in the right-hand portion of FIG. 3, is provided to guide the free end of the movable knife 23 so that the cutting edge of this knife cannot be deflected from the vertical plane including the cutting edge of the counterknife 22. A deflection of the upper knife 23 in the direction of forward movement of the web 7 (arrow 8 in FIG. 2) would prevent the cutting unit 2 from making clean cuts across the web, namely, across the lines of contact between neighboring coherent blanks of the web. The roll 27 can be replaced with other suitable means for guiding that end portion of the movable knife 23 which is remote from the holder 24 and shaft 26.

The transferring unit 3 of the improved apparatus is located immediately downstream of the cutting station including the knives 22 and 23. The unit 3 comprises a slightly inclined blank supporting plate 29 which slopes downwardly transversely of the direction of transport of the web 7 and has a flat upper side or surface 28. The upper sides 6 and 28 are located at different levels; in the illustrated embodiment, the upper side 28 of the blank supporting plate 29 is located at a level below the level of the upper side 6 of the platform 4. In order to ensure reliable and rapid transfer of a freshly separated or severed blank 31 from the plane of the upper side 6 into the plane of the upper side 28, the unit 3 further comprises displacing means for shifting successive blanks 31 from the severing station onto the upper side 28. The displacing means comprises several elongated parallel strip-shaped lowering members 32 which are mounted on a yoke-like carrier 33 which, in turn, is mounted on a supporting element 34 pivotable about the axis of the aforementioned shaft 26 for the knife holder 24. The extent of pivotal movement of the knife 23 and carrier 33 (lowering members 32) about the axis of the shaft 26 is limited by a disk-shaped cam 36 having a circumferentially extending recess 36*a* for a fixed arresting stud 37 mounted in or on the frame 21. The length of the recess 36*a*, as considered in the circumferential direction of the cam 36, determines the angle through which the knife 23 and the carrier 33 can pivot about the axis of the shaft 26, i.e., the parts 23 and 33 are limited to pivotal movements between predetermined first and second end positions. The prime mover PM can pivot the carrier 33 and the knife 23 in synchronism with movements of other mobile components of the packing machine. The arrangement is such that the upper knife 23 pivots downwardly to perform a cutting stroke while the moving unit 1 is idle, i.e., at a time when the roller 12 is not driven by the motor 16.

The plate 29 has two rows 42 and 42′ of blank holding means in the form of suction ports 38 which communicate with bores 39 in a frame member or base 41. The bores 39, in turn, communicate with the bore of a coupling device 40 which connects the member 41 with a conduit 140 having a discharge end connected with the intake of a suction fan 240 or another suitable suction generating device. An adjustable valve 340 in the conduit 140 can be actuated to connect the bores 39 with the suction generating device 240 or with the surrounding atmosphere. The rows 42 and 42′ are parallel with the cutting edges of the knives 22 and 23.

As shown in FIG. 2, the distance between the two rows 42 and 42′ of suction ports 38 is selected in such a way that it corresponds substantially to that between two parallel edges of a blank 31 on the upper side 28 of the blank supporting plate 29. This ensures that, when the ports 38 are connected with the suction generating device 240 and the upper side 28 supports a blank 31, such blank is caused to adhere to the plate 29 and is held away from the path of forward movement of the leader of the remaining portion of the web 7. As mentioned above, and as can be seen in FIG. 3, the upper side 28 of the plate 29 slopes downwardly and sideways, as considered in the direction of arrow 8. The inclination is such that the undersides of the lowering strips 32 are located in or are immediately adjacent to the upper side 28 when the upper knife 23 completes a cutting stroke, i.e., when the end portion 36*b* of the recess 36*a* in the cam 36 receives the arresting stud 37.

The foremost blank 31 can be pushed downwardly into the plane of the upper side 28 (i.e., onto the supporting plate 29) even before the cutting of such blank is completed, i.e., while the upper knife 23 performs its cutting stroke. The moving unit 1 is thereupon caused to advance the web 7 through a distance corresponding to the length of a blank 31, and such advancement can begin as soon as the lowering strips 32 return to the upper end positions which are shown in FIG. 3. Thus, the web 7 can be set in motion to advance in the direction of arrow 8 before the freshly severed blank 31 is transferred from the upper side 28 of the plate 29 which forms part of the transferring unit 3. The freshly separated blank 31 cannot interfere with forward movement of the web 7 (i.e., with forward movement of the next-following blank which is still integrally connected with the blank therebehind) because it is located in the plane of the upper side 28 which is staggered with reference to the plane of the upper side 6 of the platform 4 along which the web 7 advances in response to rotation of the advancing roller 12.

The right-hand portion of the supporting plate 29 (as viewed in FIG. 2) constitutes a stationary counterknife 10 of a corner separating or removing mechanism 5. Such right-hand marginal portion of the plate 29 is properly machined so as to be provided with a cut-off corresponding to the corner 30 shown in FIG. 7. The mechanism 5 further comprises a drive shaft 15 which receives torque from the main prime mover PM of the packing machine and carries three mobile knives 25 together constituting a star-like structure and each having a cutting edge 20 cooperating with the counterknife 10 of the plate 29 to remove a corner 30 from the blank 31 on the upper side 28 of the plate 29 when the shaft 15 is caused to perform an angular movement through 120 degrees while the web 7 is at a standstill, i.e., during an interval of dwell of the web between two successive advances in the direction of arrow 8. The distance between the plane X—X of the cutting edge of the knife 23 and the plane Y—Y of orbital movement of the mobile knives 25 corresponds to distances which are covered by the web 7 during intermittent advances in the direction of arrow 8. The arrangement is preferably such that the main prime mover PM of the packing machine sets the shaft 15 in rotary motion through 120 degrees immediately after the mobile knife 23 of the cutting unit 2 is caused to perform a working stroke or immediately after the knife 23 is set in motion toward the counterknife 22.

The freshly severed blank 31 which has been caused to descend onto the upper side 28 (and to adhere to the plate 29 because the suction ports 38 then communicate with the suction generating device 240) is transported away from the transferring unit 3 while the leader of the web 7 advances between and beyond the knives 22 and 23 of the cutting unit 2. To this end, the transferring unit 3 comprises a gripper 43 which is arranged to transfer the freshly formed blank 31 from the supporting plate 29 and transversely of the web 7, i.e., substantially at right angles to the direction of transport of the web 7 under the action of the roller 12. In the illustrated embodiment, each freshly formed blank 31 is removed in a direction to the left, as viewed in FIG. 3.

Figure 4:
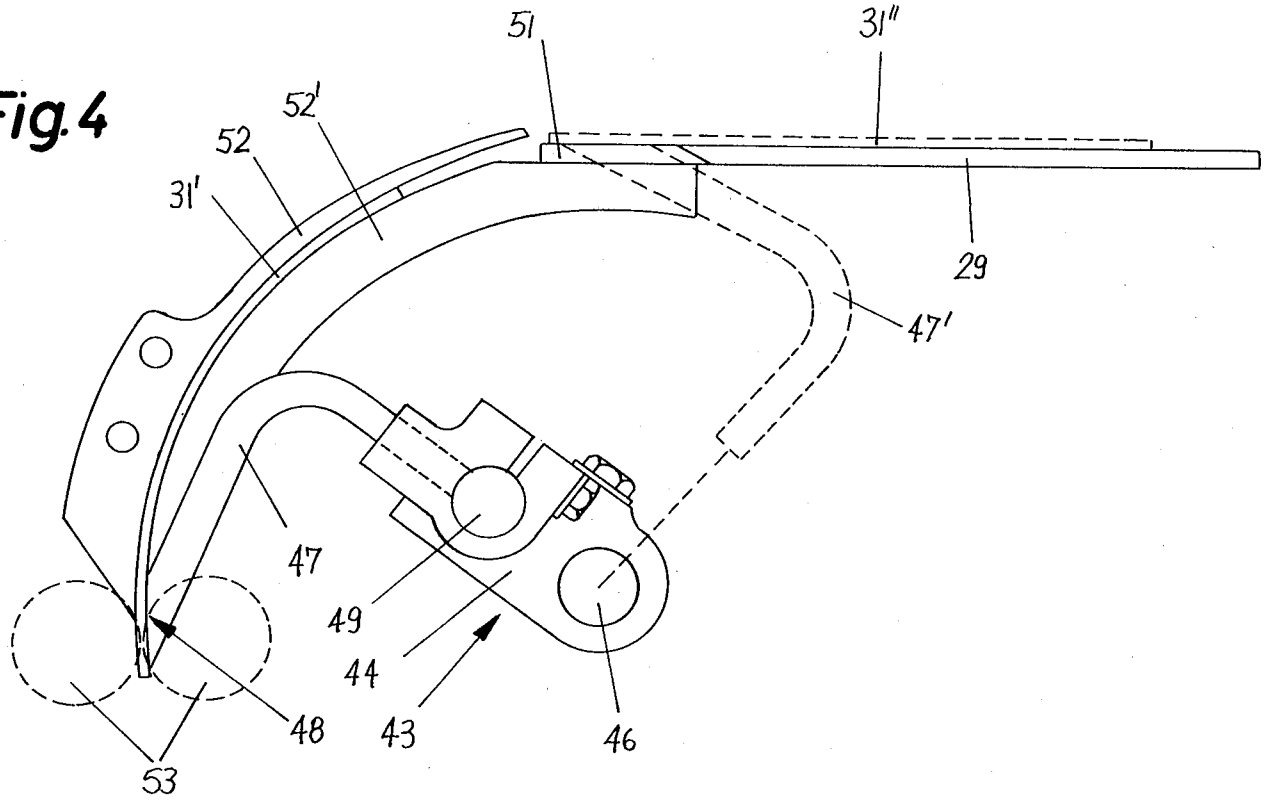
FIG. 4 shows on a larger scale a detail of the apparatus in a view corresponding to that of FIG. 3.

The details of the gripper 43 and of the means for moving this gripper are shown in FIG. 4. The gripper 43 comprises a pivotable body portion 44 which can turn back and forth about the axis of a horizontal shaft 46 and carries two parallel suction arms 47 (only the front suction arm 47 can be seen in FIG. 4). The arms 47 are hollow and their outer ends have suction apertures 48 connected with the aforementioned suction generating device 240 or with a discrete suction generating device (not shown) by a coupling 49 and a flexible hose, not shown.

That marginal portion of the plate 29 which is nearest to the gripper 43 is formed with recesses or cutouts 51 which are disposed above the suction apertures 48 when the gripper 43 is moved to its right-hand end position, as viewed in FIG. 4. This enables the suction arms 47 to attract the freshly separated blank 31 from below. The right-hand end position of the suction arm 47 which is shown in FIG. 4 is indicated by broken lines, as at 47′, and the blank 31 which is being attracted by such arm in the position shown at 47′ is shown by broken lines, as at 31″. The suction arms 47 are thereupon pivoted about the axis of the shaft 46 (in a counterclockwise direction, as viewed in FIG. 4) to remove the blank 31 by transporting it from the position 31″ and along an arcuate path which is defined by a pair of arcuate guide members 52 and 52′. For example, the blank 31 can be moved from the position 31″ (on the upper side 28 of the plate 29) to the position 31″ in which the left-hand marginal portion of the blank (as viewed in FIG. 4) extends into the nip of two intermittently or continuously driven rollers or wheels 53 serving to convey the blank 31 to the next processing station, e.g., to a mandrel which is transported in the packing machine and confines a block of properly arrayed cigarettes, cigars, cigarillos or analogous smokers' products, not shown. Reference may be had to commonly owned U.S. Pat. No. 3,956,870 granted May 18, 1976 to Friedel Kruse et al. The conveyor means including the rollers or wheels 53 can be replaced by other types of conveyor means for blanks 31 without departing from the spirit of the invention. When the suction arms 47 have completed the delivery of a freshly formed blank 31 from the position 31″ to the position 31′, they return to the end positions 47′ of FIG. 4 in order to engage and remove the next blank 31.

Figure 5:
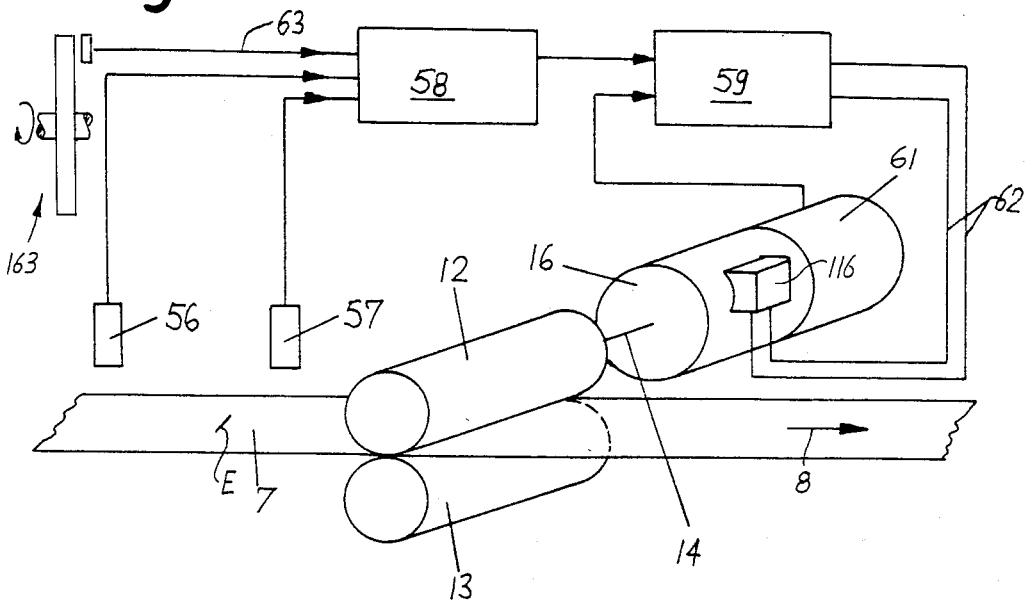
FIG. 5 is a schematic perspective view of the moving means in the apparatus of FIGS. 2 to 4 and of a control unit serving to regulate the speed of the motor which drives the web advancing means of the moving means.

FIG. 5 illustrates the control unit which regulates the operation of the moving unit 1 so as to ensure that the web 7 is invariably cut exactly across the line connecting two neighboring blanks 31. The motor 16 drives the upper roller 12 of the advancing assembly 11 by way of the output shaft 14, and the upper side of the web 7 is urged against the periphery of the roller 12 by the lower roller 13 which is preferably an idler roller.

The web 7 is provided with indicia in the form of discrete imprinted markers E, one for each of the blanks 31 (only one of these markers is shown in FIG. 5). The positions of the markers E with reference to the lines along which the neighboring blanks 31 adhere to each other upstream of the cutting unit 2 are selected in such a way that the signals which are generated by means for monitoring and detecting the markers E are transmitted at predetermined stages of movement of the foremost blank 31 of the web 7 toward and through the cutting station. The monitoring means comprises two discrete detectors 56 and 57 which constitute photoelectric transducers and are located above and in line with the path of movement of successive markers E toward the cutting unit 2. The outputs of the transducers 56 and 57 are connected with the corresponding inputs of a source 58 of reference signals which has a third input connected with a pulse generator 163 by a conductor 63. The pulse generator 163 transmits signals in rhythm with operation of the packing machine, i.e., in synchronism with movements of various mobile components of such machine. This pulse generator is driven by the prime mover PM and can comprise a disc having one or more magnets travelling past a proximity detector switch which generates a signal or pulse whenever a magnet advances therealong.

The output of the source 58 of reference signals is connected with one input of a signal comparing stage 59 another input of which is connected with a tachometer generator 61. The latter monitors the speed of the motor 16 and transmits signals denoting the speed of the shaft 14, i.e., the speed of the driven roller 12. The signal comparing stage 59 has outputs which are connected with the controls 116 for the motor 16 by conductor means 62. The signals which are transmitted by the conductor means 62 can effect acceleration, deceleration or stoppage of the motor 16, i.e., acceleration, deceleration or stoppage of the roller 12 and web 7.

The distance between the front transducer 57 and the cutting plane X—X, as considered in the direction (arrow 8) of lengthwise movement of the web 7, corresponds to the distance between a marker E and the line of connection of the corresponding blank 31 with the next-following blank. The distance between the front and rear transducers 57 and 56, again as considered in the direction of lengthwise movement of the web 7, is selected in such a way that it is in a predetermined relationship with the ratio of the two speeds of the motor 16 when the web is in motion, i.e., with the difference between the higher speed at which the web 7 is driven immediately upon completion of a cutting operation and the lower speed at which the web is driven during the interval preceding full stoppage of the web preparatory to movement of the knife 23 from its upper to its lower end position (to thereby cut the web across the line connecting the foremost blank 31 with the immediately following blank). The distance between the transducers 56, 57 exceeds or equals the distance which the web 7 covers during deceleration from the higher first speed to the lower second speed. Such spacing between the transducers 56 and 57 ensures that the web 7 invariably advances at the reduced second speed when the motor 16 receives a "stop" or "arrest" signal, i.e., when the roller 12 is to be brought to a complete halt preparatory to separation of the foremost blank 31 from the remaining portion of the web 7. Furthermore, such spacing between the transducers 56 and 57 ensures that the web 7 is advanced at the reduced second speed when a marker E moves into register with the front transducer 57 which effects stoppage of the motor 16 via signal processing means including the source 58 of reference signals, signal comparing stage 59, conductor means 62 and controls 116. An advantage of the feature that stoppage of the web 7 (i.e., the generation of a "stop" or "arrest" signal for the motor 16) is effected after the web 7 has been decelerated to the lower of two speeds is that this renders it much more likely that the moving unit 1 will arrest the web 7 at the very instant when a line at the locus of connection of the foremost unseparated blank 31 with the remaining portion of the web is in exact register with the cutting plane X—X, namely, with the vertical plane including the cutting edges of the knives 22 and 23.

The source 58 of reference signals can comprise a logic circuit and a function generator of the type shown at 77 and 78 in FIG. 4 of commonly owned U.S. Pat. No. 4,059,940 granted Nov. 29, 1977 to Menge et al. Such circuits are manufactured by the firm Hauser, Oberschopfheim, Federal Republic Germany, and are known as POS E2GN. The arrangement is such that the logic circuit causes the function generator to transmit a signal until the logic circuit receives a different signal. Thus, the function generator transmits a given signal while the logic circuit receives a signal or pulse via conductor means 63; such signal is replaced with a different signal when the logic circuit receives a signal from the detector 56; and a further signal appears at the output of the function generator when the logic circuit receives a signal from the detector 57.

The signal comparing stage 59 is of conventional design.

Figure 6:
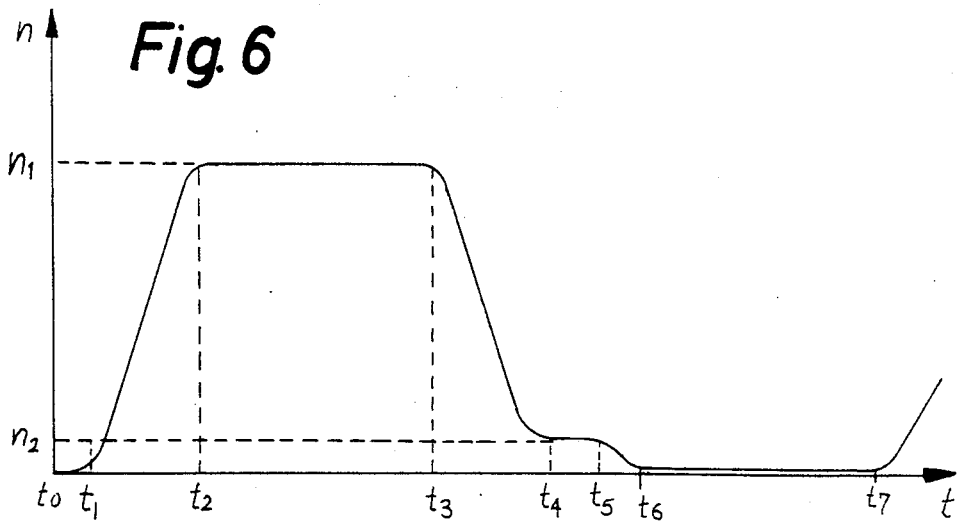
FIG. 6 is a velocity-time diagram denoting the speed of the web during different stages of movement through a distance corresponding to the length of a blank and during separation of the foremost blank from the remainder of the web.

The operation of the apparatus which is shown in FIGS. 2 to 5 is as follows:

As already mentioned above, the moving unit 1 is designed to advance the web 7 in stepwise fashion. In FIG. 6, the velocity n of the web 7 (i.e., the RPM of the output shaft 14 and roller 12) is measured along the ordinate, and the time t is measured along the abscissa. A cycle is completed during the interval between the instants $t_0$ and $t_7$. The motor 16 is idle during the interval between the instants $t_0$ and $t_1$ (i e., the velocity n of the web 7 is then zero). The conductor 63 transmits a pulse from the pulse generator 163 at the instant $t_1$ whereby the roller 12 is rapidly accelerated from zero speed to the maximum or first speed $n_1$ (such acceleration is completed during the interval between $t_1$ and $t_2$), i.e., the web 7 is transported lengthwise (arrow 8) at the first speed $n_1$ shortly after the uppermost input of the source 58 of reference signals shown in FIG. 5 receives a signal from the pulse generator 163. The web 7 continues to advance at such maximum or first speed $n_1$ until the major part of the foremost unseparated blank 31 advances beyond the cutting plane X—X, i.e., beyond the cutting edges of the knives 22 and 23. This means that the major part of the foremost unseparated blank 31 is advanced beyond the knives 22, 23 and into the transferring unit 3 (i.e., into the space above the upper side 28 of the blank supporting plate 29) before the speed of the motor 16 is reduced. Such reduction is caused by the rear transducer 56 in response to detection of the oncoming marker 54. The (first) signal which the transducer 56 transmits to the median input of the source 58 of reference signals causes the source 58 to transmit a signal which is applied to the motor controls 116 via signal comparing stage 59 and conductor means 62 so that the speed of the roller 12 is rapidly reduced from $n_1$ to the lower or second speed $n_2$ which can be and preferably is only a small fraction of the speed $n_1$. The interval between the instants $t_2$ and $t_3$ is that period during which the web 7 is advanced at the first speed $n_1$, and the interval between the instants $t_3$ and $t_4$ elapses during deceleration of the web 7 from the first speed $n_1$ to the second speed $n_2$. The stage 59 compares the signal which is transmitted by the source 58 in response to detection of the oncoming marker E by the transducer 56 with the signal which is transmitted by the tachometer generator 61 and then furnishes a signal or a set of signals which initiate the reduction of speed from $n_1$ to $n_2$ within the interval which elapses between the instants $t_3$ and $t_4$. The speed of the web 7 is reduced from $n_1$ to $n_2$ before the marker E which has induced the transducer 56 to transmit the just discussed signal to the median input of the source 58 reaches the transducer 57. Thus, the web 7 is advanced at the lower or second speed $n_2$ during a certain stage of its lengthwise movement through a distance corresponding to the length of a blank 31, namely, during the interval between $t_4$ and $t_5$, as viewed in FIG. 6. The marker E then reaches the transducer 57 which transmits to the lowermost input of the source 58 a (second) signal serving to initiate complete stoppage of the motor 16. Such stoppage takes place after a relatively short interval of time (between $t_5$ and $t_6$ as seen in FIG. 6) which can be calculated and maintained with a high degree of accuracy because the second speed $n_2$ need not be high, i.e., the web 7 can be reliably arrested in a position in which the line between the foremost blank 31 and the remaining portion of the web 7 is located in exact register with the cutting edges of the knives 22 and 23. The web 7 is thereupon maintained at the speed $n=0$ for an interval which elapses between the instants $t_6$ and $t_7$ and which is sufficiently long to allow for completion of the cutting operation, for return movement of the knife 23 and lowering strips 32 to the upper end positions shown in FIG. 3, and for completion of a severing operation by one of the knives 25.

As explained in connection with FIGS. 2 and 3, the lowering strips 32 share the pivotal movements of the upper knife 23 and cause the foremost blank 31 of the web 7 to move into the plane of the upper side 28 of the plate 29 in the course of the cutting operation, i.e., while such blank 31 is in the process of being separated from the remaining portion of the web 7. The lowered foremost blank 31 is attracted by the plate 29 because the suction ports 38 in this plate then communicate with the intake of the suction generating device 240. The shaft 15 is then rotated through 120 degrees so that one of the cutting edges 20 cooperates with the counterknife 10 of the mechanism 5 and removes a corner 30 from the blank 31 on the upper side 28 of the plate 29. The connection between the ports 38 and the devices 240 remains intact until the suction arms 47 assume the positions 47', i.e., until the free end portions of the suction arms 47 enter the cutouts 51 of the plate 29 so that the apertures 48 (which then communicate with the corresponding suction generating device) ensure that the freshly separated blank 31 is compelled to share the movements of the suction arms 47 from the positions 47' to the solid-line positions of FIG. 4. The valve 340 connects the suction ports 38 to the atmosphere when the arms 47 assume the positions 47' so that these ports do not interfere with movement of the freshly separated blank 31 from the position 31'' to the position 31' of FIG. 4. The guides 52 and 52' ensure that the blank 31 remains in a predetermined arcuate path during travel from the position 31'' to the position 31', i.e., that the left-hand edge or marginal portion of such blank enters the nip of the wheels 53 which convey the blank to the next processing station, such as the aforediscussed wrapping station where the blank is draped around a mandrel and around the block of properly arrayed cigarettes in such mandrel. The gripper 43 is thereupon immediately returned to its normal position in which the arms 47 assume the broken-line positions 47' of FIG. 4 and are ready to attract and remove the next blank 31 (which then occupies the position 31'' of FIG. 4).

The web 7 can be advanced while the arms 47 transport a freshly separated blank 31 from the plane of the upper side 28 of the plate 29 because this plane is located at a level below that of the upper side 6 of the platform 4. Thus, all that is necessary is to maintain the web 7 at a standstill during cutting by the edges of the knives 22, 23 and during the immediately following rapid retraction of the knife 23 and lowering or displacing strips 32 to the upper end positions of FIG. 3. As mentioned above, the freshly separated blank 31 is attracted by the suction ports 38 as soon as it reaches the plane of the upper side 28 of the plate 29 so that such blank cannot interfere with the forward movement of the next blank 31 into the space behind the cutting plane X—X, i.e., into the space above the plate 29.

It goes without saying that the markers or indicia E can be replaced by other types of indicia which need not be imprinted onto the web 7, e.g., by indicia in the form of perforations, notches or combinations of several different indicia (e.g., a marker in the form of a perforation and a marker in the form of a notch). The nature and mode of application of indicia depend on the selected monitoring means, on the nature of signals which are to be transmitted to the selected source of reference signals, and on the nature of treatment to which the web is subjected prior to subdivision into discrete blanks 31.

It has been found that the improved apparatus allows for the making and processing of a larger number of blanks per unit of time than any heretofore known apparatus. This is attributable to the fact that the web 7 can be caused to advance (at the higher first speed $n_1$) while the freshly separated blank 31 is still located in the transferring unit 3, i.e., on the upper side 28 of the plate 29. The plane of the upper side 28 is not identical with that of the upper side 6, i.e., the freshly separated blank 31 cannot interfere with forward movement of the leader of the remaining portion of the web 7, even though such freshly separated blank is still located in the transferring unit 3.

Another important advantage of the improved apparatus is that the web 7 can be arrested in accurately determined positions, i.e., always when the line between two neighboring blanks is in exact alignment with the cutting edges of the knives 22 and 23. Therefore, the dimensions of all blanks 31 are the same and each of these blanks carries the entire image which is to be seen at the outer side of the respective pack. Furthermore, the moving, cutting and transferring units 1, 2 and 3 are very simple and compact so that the improved apparatus occupies a surprisingly small amount of space in a packing machine for cigarettes or the like. The control means for the motor 16 are simple and reliable so that the apparatus requires a minimum of maintenance and a minimum of supervision in actual use of the packing machine.

A further important advantage of the improved apparatus is that the web and the blanks are treated gently, i.e., there is no need to employ entraining elements in the form of pawls whose pallets or like elements must penetrate into marginal notches or perforations of the web in order to entrain the web during the last stage of forward movement to a position in which a line between two neighboring blanks is in exact register with the cutting edge of the stationary knife. This also contributes to a higher output of the apparatus because the number of rejects is negligible or zero and the packing machine is less likely to turn out defective packs which require segregation from packs having satisfactory envelopes.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of subdividing a web into discrete sections, particularly for subdividing a web of wrapping material into a succession of discrete blanks preparatory to conversion of such blanks into the constituents of soft packs for arrays of cigarettes or the like, comprising the steps of moving the web lengthwise in a predetermined direction and in stepwise fashion across a fixed cutting plane so that the foremost portion of the web is located at one side and the remaining portion of the web is located at the other side of such cutting plane; making cuts across the web during the intervals of dwell of the web between successive stepwise movements so that the foremost portion is separated from the remaining portion of the web and such portions of the web are provided with corners disposed at the respective sides of the cutting plane; and removing at least one corner from at least one portion of the web during each interval of dwell of the web.

2. The method of claim 1, wherein said removing step includes severing a corner from the foremost portion of the web not later than upon at least partial separation of the foremost portion from the remaining portion of the web.

3. The method of claim 2, wherein said severing step includes removing from the foremost portion a corner formed thereon while the foremost portion was an integral part of the remaining portion of the web.

4. The method of claim 1, further comprising the steps of providing the web with a succession of longitudinally spaced-apart indicia and utilizing successive indicia for selection of the length of successive stepwise movements of the web in said direction.

5. The method of claim 4, wherein said utilizing step includes optically scanning the web for the presence of indicia at a predetermined location ahead of said cutting plane, as considered in said direction, generating signals on detection of successive indicia, and arresting the web in response to generation of such signals.

* * * * *

UNITED STATES PATENT AND TRADEMARK OFFICE

CERTIFICATE OF CORRECTION

PATENT NO. : 4,571,231

DATED : February 18, 1986

INVENTOR(S) : Willy RUDSZINAT et al.

It is certified that error appears in the above-identified patent and that said Letters Patent are hereby corrected as shown below:

Foremost page [75] Inventors: after Marschacht, delete "both" and add --Reinhard Deutsch, Geesthacht, all--.

Signed and Sealed this

*Twenty-second* Day of *July 1986*

[SEAL]

*Attest:*

DONALD J. QUIGG

*Attesting Officer*

*Commissioner of Patents and Trademarks*